US009393475B2

(12) United States Patent
Colan

(10) Patent No.: US 9,393,475 B2
(45) Date of Patent: Jul. 19, 2016

(54) PROGRESSIVE RESISTANCE SYSTEM FOR AN EXERCISE DEVICE

(71) Applicant: SportCrafters, Inc., Granger, IN (US)

(72) Inventor: Peter Colan, Granger, IN (US)

(73) Assignee: SportCrafters, Inc., Granger, IN (US)

( * ) Notice: Subject to any disclaimer, the term of this patent is extended or adjusted under 35 U.S.C. 154(b) by 362 days.

(21) Appl. No.: 14/035,787

(22) Filed: Sep. 24, 2013

(65) Prior Publication Data

US 2014/0296038 A1 Oct. 2, 2014

Related U.S. Application Data

(60) Provisional application No. 61/704,789, filed on Sep. 24, 2012.

(51) Int. Cl.

| | |
|---|---|
| ***A63B 21/00*** | (2006.01) |
| ***A63B 69/16*** | (2006.01) |
| ***A63B 21/005*** | (2006.01) |

(52) U.S. Cl.

CPC ..... *A63B 69/16* (2013.01); *A63B 21/0051* (2013.01); *A63B 21/00069* (2013.01); *A63B 2069/167* (2013.01); *A63B 2069/168* (2013.01)

(58) Field of Classification Search

CPC ..... A63B 21/00
USPC ..... 482/54, 57
See application file for complete search history.

(56) References Cited

U.S. PATENT DOCUMENTS

| | | | |
|---|---|---|---|
| 6,042,517 | A | 3/2000 | Gunther et al. |
| 6,857,992 | B1 | 2/2005 | Kolda et al. |
| 6,964,633 | B2 | 11/2005 | Kolda et al. |
| 7,011,607 | B2 | 3/2006 | Kolda et al. |
| 7,585,258 | B2 | 9/2009 | Watson et al. |
| 2005/0064999 | A1 | 3/2005 | Qiu |

FOREIGN PATENT DOCUMENTS

| | | | |
|---|---|---|---|
| EP | 0621058 | A1 | 10/1994 |
| EP | 1683550 | A1 | 7/2006 |
| WO | 2010/104405 | A2 | 9/2010 |

*Primary Examiner* — Jerome w Donnelly
(74) *Attorney, Agent, or Firm* — Botkin & Hall, LLP

(57) ABSTRACT

A progressive resistance device is provided having a cylinder having an outer wall which defines an inner chamber. The cylinder is carried on an axle and is rotatable thereabout. An eccentric axle surrounds the axle and is rotatable relative the axle. A magnet carrier partially encircles the eccentric axle and carries a magnet. A bearing is nested between the magnet carrier and the eccentric axle. The magnet carrier is rotatable about the eccentric axle on an axis which is eccentric to the axle's axis, whereby the distance between the magnet and the outer wall is variable as defined by the rotative position of said housing relative said outer wall, which rotative position is governed by the speed of rotation of the cylinder. The progressive resistance device described herein is adapted for use as a roller on a bicycle trainer.

20 Claims, 8 Drawing Sheets

PROGRESSIVE RESISTANCE SYSTEM FOR AN EXERCISE DEVICE

CROSS REFERENCE TO RELATED APPLICATIONS

This application claims the benefit of the prior filed provisional application Ser. No. 61/704,789, filed Sep. 24, 2012, incorporated by reference herein.

BACKGROUND OF THE INVENTION

Bicycle rollers have been in use since the early 1900's. A bicycle roller is a dynamometer for bicycles that is powered by the bicycle rider. A bicycle roller is traditionally comprised of three rotatable cylinders positioned so that the rear wheel of the bicycle rides on two closely-spaced cylinders, and the front wheel of the bicycle rides on a third cylinder. In the typical application, the cylinder under the front wheel is coupled to one of the cylinders under the rear wheel by an elastic band such that the front cylinder is forced to rotate at approximately the same speed as the rear two cylinders. This allows the rider to control the bicycle, with steering enabled due to the rotation of the front wheel.

In the prior art, the amount of power, or wattage, that the bicyclist is required to exert to ride at a given speed on a bicycle roller was determined by the amount of rolling resistance resulting from tire distress as the tire rolls over each of the cylinders plus the wattage required to drive any external devices which exert resistance on one or more of the cylinders. Rolling resistance is predominantly a function of the cylinder diameter, tire pressure, and bicyclist weight. Relying on these factors alone provides a linear relationship of resistance versus speed. Simple devices that add a predictable amount of resistance such as the magnetic eddy-current device of U.S. Pat. No. 6,857,992 (incorporated herein by reference) can be added externally to the cylinders, but these are undesirable since they provide a linear speed-to-resistance relationship.

Prior art bicycle rollers have a linear relationship of speed versus resistance. This solution is unsatisfactory; when beginning to pedal the bike from rest on rollers, low resistance is desired to allow the wheels to accelerate quickly enough to enable sufficient steering dynamics to keep the bicycle stable on the rollers, however, to obtain a meaningful training session, a high amount of resistance is desired when pedaling at a rate suitable to achieve cardiovascular exercise benefit.

To achieve both objectives it is desired to have a "progressive" resistance relationship with speed. In other words, a non-linear relationship between speed and resistance where the slope of resistance versus speed increases with increasing speed is desired. This relationship is preferred because it mimics the non-linear effect of combined rolling resistance and wind resistance experienced when riding a bicycle in traditional fashion.

Stationary trainers that use devices external to the rollers, such as fluid resistance, friction, air-moving technologies or variable magnetic resistance devices (see U.S. Pat. No. 7,011,607, incorporated herein by reference) are designed to resemble realistic bicycle riding conditions. Each of these devices is external to the roller. Other than adding this type of device to a bicycle roller, and driving it through a power-transmission device, or through a complicated mechanical coupling to one of the driven cylinders, no attempt has been made to fully integrate progressive resistance technology within the drum of a bicycle roller so that external devices are not necessary. As such, an improved bicycle roller is desired.

SUMMARY OF THE INVENTION

This disclosure describes an improved progressive resistance device suitable for integration with a bicycle roller training device. The progressive resistance device is a conductive cylinder, or drum, having an outer wall defining an internal chamber. One or more magnets is carried on a magnet carrier and housed within the internal chamber and in proximity to the wall. Eddy currents produced in the conductive cylinder as the cylinder spins alter the magnet's proximity to the wall by forcing the magnet carrier to move in an eccentric orientation as relates to the axis of rotation of the cylinder. A torsional spring opposes the force created by the eddy current and causes the system to achieve a state of equilibrium force balance.

With the cylinder oriented such that rotation allows the magnet carrier to move against the torsional spring, the result is a progressive relationship between speed and resistance.

Another benefit of the progressive resistance device described herein is that when a linear relationship between speed and resistance is desired, the cylinder may be reversed—such that the cylinder rotates in the opposite direction described above—allowing the same progressive resistance device to provide either linear or proportional training depending on the direction of rotation of the cylinder. With the progressive resistance device reversed, the result will be a linear relationship of speed and resistance. Therefore, the progressive resistance device described herein is unique in that it allows the user to select progressive resistance or linear resistance, as desired. The ability to make this selection is important because a user training on rollers on any given day may prefer high wattage or low wattage at high speed. In practice, the progressive resistance device is removable from the frame and is reversible, to allow the user to select linear or progressive resistance.

For most bicycle riders, the use of a trainer having a single progressive resistance device described herein may be adequate. However, because a bicycle roller comprises three cylinders, typically identical, the use of one, two, or three progressive resistance devices described herein may be used in the place of the roller's cylinders to achieve differing levels of resistance.

By adjusting the spring rate, spring preload, number of magnets and other variables it is possible to adjust the progressive relationship between resistance and speed to suit the needs of the designer or the user.

An additional embodiment of this technology to achieve a higher level of resistance on a single cylinder is to include stationary magnets on the outer side of the progressive resistance device placed and oriented in such a way that: a) when the progressive resistance device is at rest, the poles of the moveable magnets inside the cylinder oppose the stationary magnets outside the cylinder, thereby reducing the magnetic flux on the conductive cylinder wall and b) when the progressive resistance device rotates during its normal operation, the moveable magnets inside the cylinder approach stationary magnets on the outside of the cylinder in such a way that the magnets are attracted by appropriate pole alignment, thereby increasing the magnetic flux on the conductive cylinder wall.

Further, the progressive resistance device described herein is applicable to other stationary trainers, such as those sold for use with bicycles, handcycles and tricycles (see U.S. Pat. Nos. 7,011,607, 7,585,258, 6,964,633, and 6,042,517, each incorporated herein by reference). The progressive resistance device described herein is distinguishable from the magnetic resistance system for rollers (U.S. Pat. No. 6,857,992, incorporated herein by reference) in that the progressive resistance device automatically adjusts resistance level relative to speed, rather than being manually adjustable.

Applications of this technology are not limited to bicycle rollers and bicycle trainers, but are suitable in any application where a resistance mechanism is employed and it is desired that the resistance mechanism have a non-linear relationship to speed, such as a stationary bicycle, hand cycle ergometers, and any similar device. Because the progressive resistance device described herein is contained within a cylindrical drum and requires only that the outer cylinder be rotated, it can be driven by direct contact with a bicycle tire, or it can employ a chain and sprocket, a drive belt or it can be driven directly by any means to cause rotation of a cylinder on an axle.

A roller-type stationary bicycle trainer includes a framework typically consisting of two frame members flanking and adjoined to three cylindrical roller drums. Each frame member consists of two parts: a front frame member that allows for various placements of the front cylindrical roller drum relative to the two rear cylindrical roller drums and a rear frame member which is adjoined to the two rear cylindrical roller drums. In one instance, the frame members are pivitolly attached to each other to enable the trainer to fold for storage. It is understood that this description is only indicative of one type of trainer such as the type designed and produced by SportCrafters, Inc. from Granger, Indiana known as the ZRO aluminum or ZRO PVC. Other configurations of attaching cylindrical rollers with a framework intended to appropriately space the rollers and allow for adjustment of the cylinders for use with various bicycles may be employed.

A power transmission device, which can be a chain, belt or any similar device is typically installed between the front cylinder and the middle cylinder, preferably, an elastic belt. The power transmission device is typically carried in a groove formed in the cap of the cylinder. In other applications the power transmission device is installed between the front cylinder and the rear cylinder. In any case, the power transmission belt is employed to cause the front cylinder to rotate in the same direction, and at approximately the same rate, as either one of the rear cylinders.

When the progressive resistance device is used, the driven wheel of the bicycle is placed on the two rear cylinders and the front wheel of the bicycle is placed on the front cylinder. When the bicycle is powered by the rider, the rotation of the rear wheel of the bicycle will cause the rear roller drums to rotate, and through the belt drive, this will also cause the front roller drum to rotate in the same direction. Therefore, the front wheel of the bicycle will also rotate in the same direction and approximate speed as the rear wheel of the bicycle.

In an additional embodiment, a similar roller-type stationary bicycle trainer is provided which is suitable for use with tricycles and handcycles—where the need for the user to balance on the trainer is not required—includes a framework of two rails adjoining two cylindrical roller drums one of the roller drums is a progressive resistance device. It is further understood that this illustration is indicative of the type of trainer designed and produced by SportCrafters Inc from Granger, Ind. sold under the name Mini-roller. In this application, not requiring the skill of the user to balance, the driven wheel of the bicycle is placed between the two roller drums and aligned in such a way that the tire of the bicycle, tricycle, or handcycle remains in contact with the roller drums during use. In a manner as is known, the user pedals the bicycle, tricycle or handcycle so as to rotate the driven wheel which in turn rotates the two cylinders supporting the driven wheel.

DESCRIPTION OF THE PREFERRED EMBODIMENT

Figure 1:
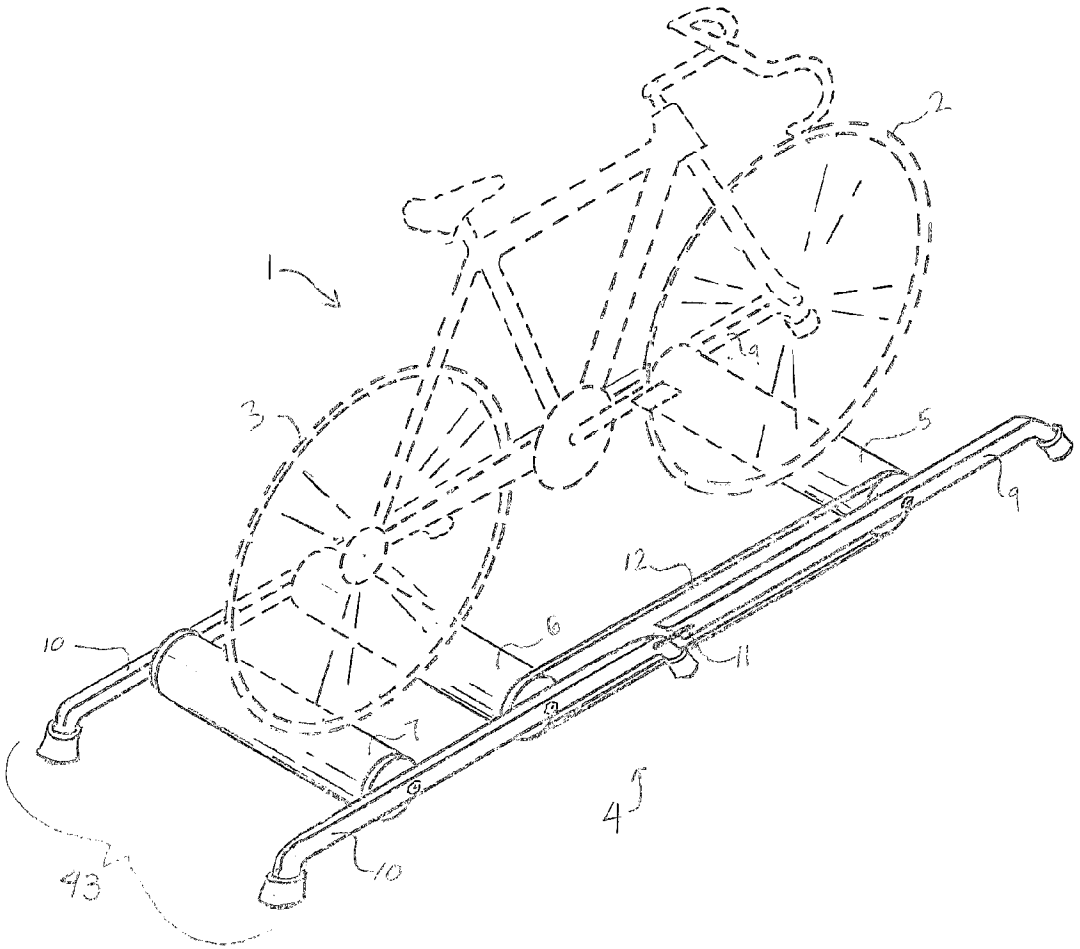
FIG. 1 is a perspective view of a bicycle on a training roller assembly including a progressive resistance device in the place of one of the cylinders.

In the embodiment depicted in FIG. 1, a bicycle 1 having a front wheel 2 and a rear wheel 3—powered conventionally by means of a crank, chain or other means of applying human power to rear wheel 2—is positionable on top of a training roller assembly 4. The roller assembly 4 includes three rotating cylinders, or drums—a front drum 5, a middle drum 6 and a rear drum 7—carried by a frame 43. In one embodiment, the frame 43 is formed having two front frame members 9, two rear frame members 10, two hinges 11, and an elastic drive belt 12. One of the front frame members 9 is attached by one of the hinges 11 to one of rear frame member 10, the group forming one side of the frame 43. Another of the front frame members 9 is attached by another of the hinges 11 to another of the rear frame member 10, the group forming another side of the frame 43. The one and the other sides of the frame 43 are joined together by drums 5, 6, 7 which span therebetween. Drums 5, 6, 7 are laterally spaced from one another along the frame 43. The middle drum 6 and the rear drum 7 are spaced apart such that the rear wheel 3 contacts both drums and will not tend to roll over the top of the middle drum while under power. This is typically accomplished by using a ratio of the diameter of the rear wheel 3 divided by the centerline distance between the drums roughly equivalent to 2.5. Therefore, as an example, a 27-inch diameter rear wheel would work well with an 11 inch distance between the cylinders. If the distance between the drums 6, 7 were smaller, there may be a tendency for the bicycle to roll over the middle drum when the bicycle is powered by the rider. If the distance were wider, there may be excessive pinching of the tire resulting in very high rolling resistance and tire wear. As the drums 5, 6, 7 rotate, they contact the surrounding air, and are cooled by forced convection. The drums 5, 6, 7 are preferably formed from a material which readily dissipates heat, such as aluminum.

The distance between the front drum 5 and the middle drum 6 is adjusted by anchoring the front drum 5 at any one of a plurality of adjusting holes 14 formed through both of the front frame members 9 such that the front wheel 2 of the bicycle 1 is positioned such that the axle of the front wheel 2 is offset above with the axle of the front drum 5. An elastic drive belt 12 spans between the middle drum 6 and the front drum 5 such that the front drum 5 turns in the same direction as the middle and rear drums, enabling the bicycle to be operated using the normal dynamics of steering and balance. The elastic drive belt 12 is carried in a groove formed in the cap of the respective drum.

Figure 2:
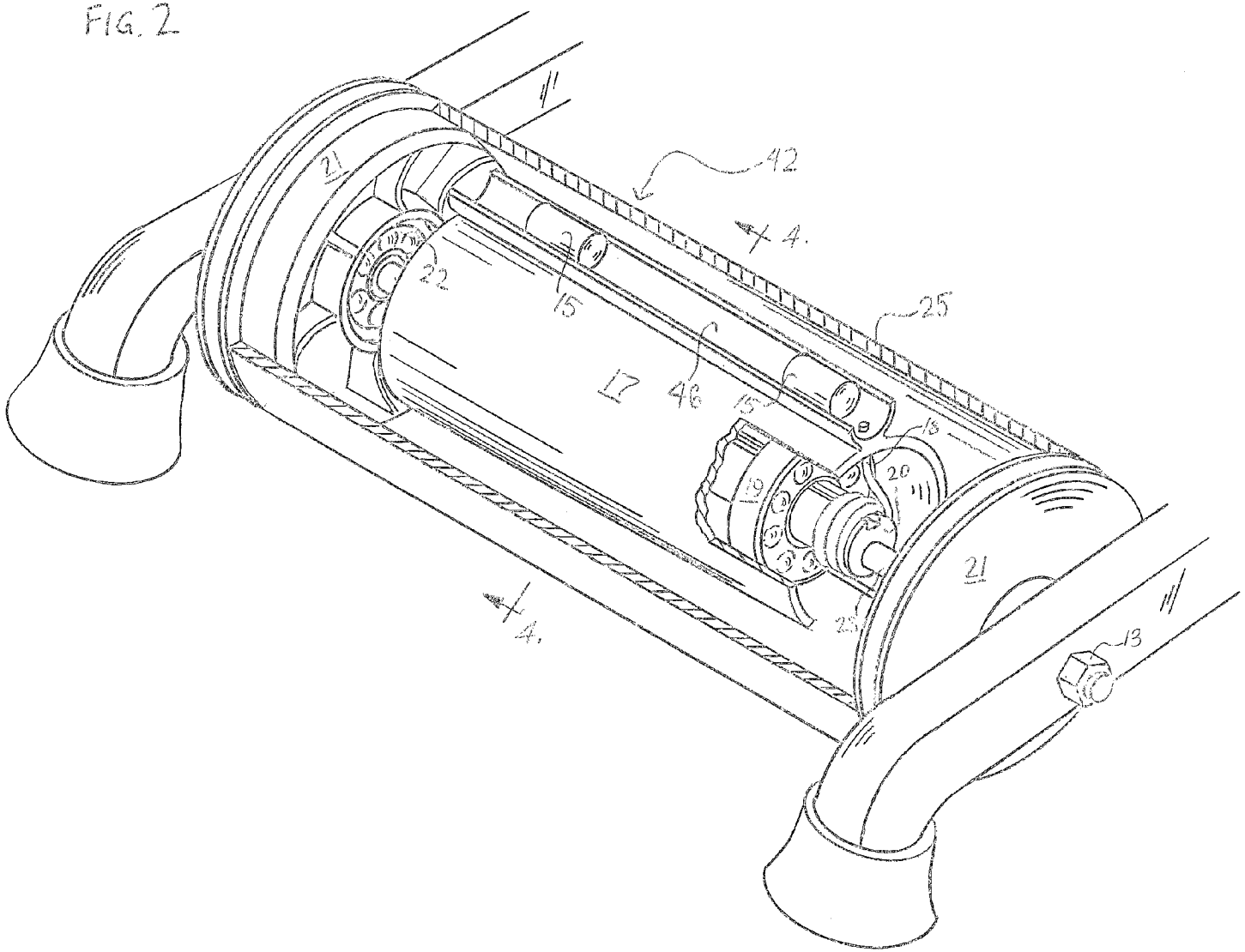
FIG. 2 is a cutaway perspective view of the progressive resistance device shown in FIG. 1.
Figure 3:
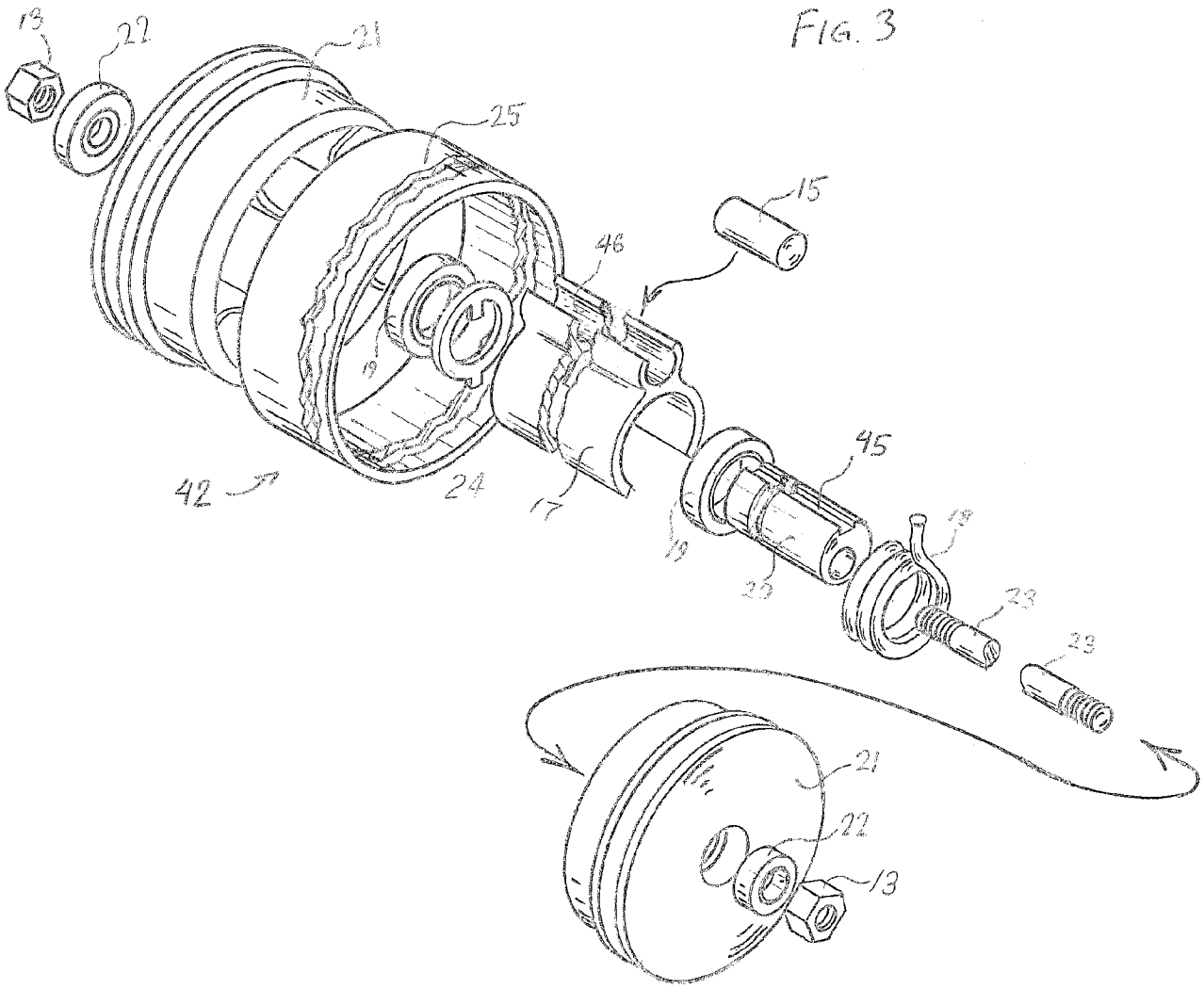
FIG. 3 is an exploded view of the progressive resistance device of FIG. 2.

This disclosure describes a typical bicycle roller assembly 4 as depicted by FIG. 1 whereby any one, two or three of the drums 5, 6, 7 house a resistance mechanism 42 as depicted in FIG. 2 and FIG. 3. For the purpose of illustration, the resistance mechanism 42 in FIG. 2 is represented as the rear drum 7, but it can be positioned in any of the three locations on roller assembly 4.

The resistance mechanism 42 is used in place of one or more of the drums 5, 6, 7 and is formed having a drum axle 23 which is a straight rod having threaded ends and fasteners 13 suitable for securing the axle 23 to the roller frame 4. A cylinder 25, made from electrically conductive material, forms the outer wall of the drum and defines an internal chamber. An eccentric axle 20 encircles the axle 23 and includes a wall having variable thickness. The eccentric axle 20 is rotatable around the axle 23. A torsional spring 18 includes coils which encircle a portion of the eccentric axle 20, which spring provides an opposing force to the rotation of the eccentric axle 20, as described in greater detail below. One or more magnet bearings 19 encircle the eccentric axle 20 and allow a magnet carrier 17 to rotate relative the eccentric axle 20. The magnet carrier 17 includes a channel 46 for carrying one or more magnets 15. The magnet carrier 17 encircles the eccentric axle 20 with the magnet bearings 19 sandwiched between the eccentric axle 20 and the magnet carrier 17. The magnet carrier 17 is preferably formed from a non-magnetic material. The eccentric axle 20 provides the centerline of rotation for the magnet bearings 19, said centerline being offset from the centerline of the axle 23 by a predetermined amount. The end caps 21 cap the ends of the cylinder 25, with each end cap 21 having a drum bearing 22 installed into the end caps 21 which bearings allow the cylinder 25 to rotate about the axle 23. The end caps 21 serve to locate the axle 23 in the center of the cylinder 25. A rotational stop 24 may be optionally employed to limit the rotation of the magnet carrier 17 about the eccentric axle 20 to enable a limitation to the minimum or maximum resistance as will be described below. The eccentric axle 20 includes one or more axial grooves for accepting an end of the spring 18, thereby holding the end of spring in fixed rotation with the eccentric axle 20. The magnet carrier 17 includes an aperture for accepting another end of the spring 18, thereby the spring 18 is able to exert a force between the eccentric axle 20 and the magnet carrier 17 when they are rotated relative one another. In one embodiment, the magnet carrier 17 only partially encircles magnet bearings 19, having an axial gap formed along the length of the magnet carrier. A rib 47 is formed proximate the gap formed in the magnet carrier 17. The rib 47 contacts the magnet bearings 19, and ensures contact therebetween; in one embodiment a rib 47 is formed on the magnet carrier 17 on each side of the gap. Similarly, a rib 48 is formed proximate the edge of a gap formed in the channel 46 for purposes of contacting and holding firm a cylindrically-shaped magnet 15.

Figure 5:
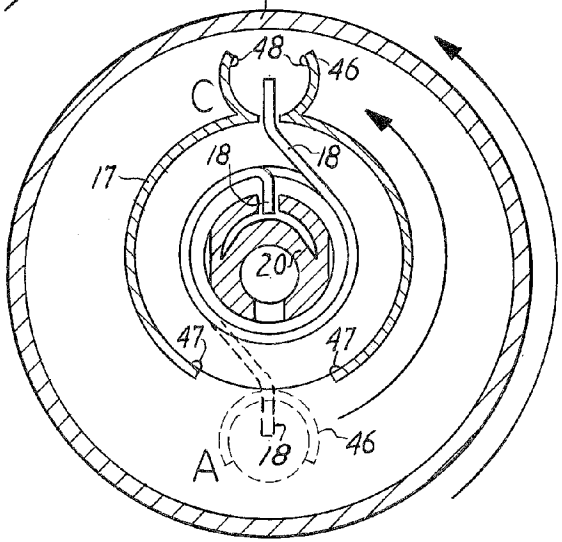
FIG. 5 is a sectional side view of the progressive resistance device of FIG. 2 and showing the torsional spring.
Figure 4:
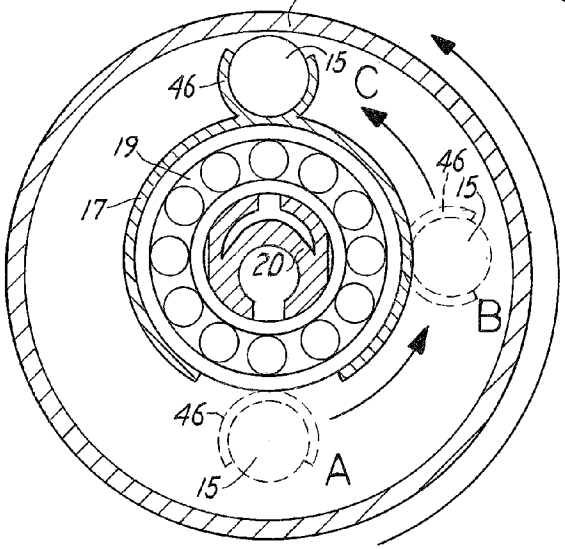
FIG. 4 is a sectional side view of the progressive resistance device of FIG. 2 and showing three positions of the magnets.

The axle 23 mounts the drum (each of drums 5, 6, 7 having a separate axle 23) to the frame 43. The cylinder 25 is rotatable about the axle 23. As described in detail below, rotation of the cylinder 25 causes the resistance mechanism 42 to resist rotation of the cylinder. As shown in FIGS. 4 and 5, when the cylinder 25 is at rest (not rotating), the torsional spring 18 is at its free state and the position of the magnets 15 is held by said spring and/or the optional rotational stop 24 in Positions A or B, or anywhere in this general area. Position A is the point where a maximum gap exists between the magnets 15 and the cylinder 25, and Position C is the point where a minimum gap exists between the magnets 15 and the cylinder 25, the gap at position B is approximately 50% of the differential gap as measured at Positions A and C.

It is important to note that in Positions A, B, and C the magnets 15 must be sufficiently close to the wall of the cylinder 25 to allow a flux field of the magnets 15 to pass through the wall of the conductive cylinder 25. The presence of the flux field through the wall of the conductive cylinder 25 will cause a flow of electrons, otherwise known as an eddy current, when the cylinder is in motion relative to the magnets 15. The strength of the resulting magnetic field from the eddy current must be sufficient to rotate the magnet carrier 17 about the eccentric axle 20 as a result of the force exerted on the magnets by the eddy current. The torsional spring 18 applies a force which resists rotation of the magnet carrier 17.

Figure 6:
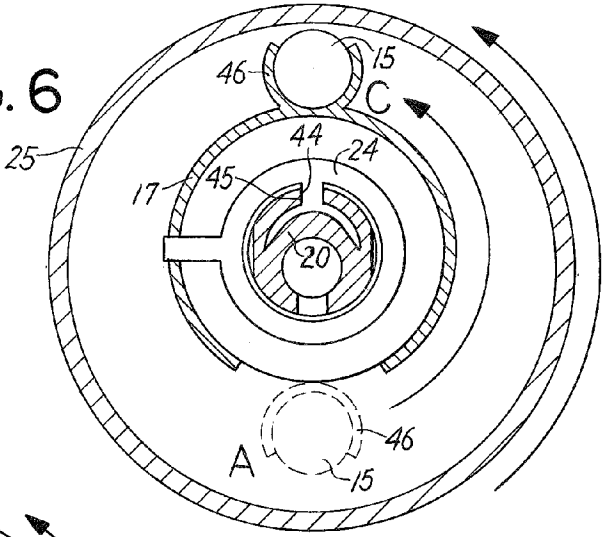
FIG. 6 is a sectional side view of the progressive resistance device of FIG. 2 and showing the rotational stop

Therefore, when the conductive cylinder 25 is rotated in the direction of the arrows shown in FIGS. 4-6, the magnet 15 will cause an eddy current to form in the cylinder 25 and will create a localized magnetic field which opposes the field of the magnets 15; a force is exerted on the magnets 15 in a direction tangential to the surface of the conductive cylinder in the proximity of the magnets. Constrained by the eccentric axle 20 and magnet bearings 19 the tangential direction of force translates to a circumferential rotation of the magnet carrier 17 resulting in a decreased radial gap between the magnets 15 and the conductive cylinder 25 as the rotational speed of the cylinder 25 increases.

As depicted in FIG. 6, the relative rotation of the magnet 15 and the magnet carrier 17 can be constrained by a rotational stop 24 wherein the stop 24 has an inwardly-extending tab 44 which seats in the groove 45 of the eccentric axle 20. An outwardly extending tab 49 is formed on the stop 24 which restricts rotation of the magnet carrier 17 by contacting the edges of the magnet carrier which form the axially-extending gap formed in the magnet carrier 17 opposite the channel 46, thereby limiting the rotation of the magnet carrier 17 relative the eccentric axle 20.

There is a direct relationship between the speed of rotation of the conductive cylinder 25 and the degree of rotation of the magnet carrier 17. Said relationship is most easily understood by the principle that faster rotation between a conductive surface relative a magnet produces higher electron flow and eddy current in the conductive material, resulting in a stronger magnetic field produced by said eddy current. This magnetic field exerts a force on the magnets 15 which in turn rotates the magnet carrier 17 about the eccentric axle 20, which rotation is resisted by the torsional spring 18. Therefore, there exists a higher amount of induced torque on the torsional spring at higher cylinder rotational speeds and the spring will wind up until the torque balances the resistive spring force. For a given rotational speed of the conductive cylinder 25, a given force balance will exist between the magnet 14 and the torsional spring 18 which will correspond to a given resistive force acting against the rotation of the conductive cylinder at that given speed.

Further, there is a direct relationship between the degree of rotation of the magnet carrier 17 and the power required to continue rotating the conductive cylinder 25. Since it was already established that the degree of rotation is directly related to torque, and that power is proportional to torque times angular velocity, then it can be said that more power is required to rotate the cylinder a higher velocity.

A non-linear relationship between power and cylinder rotational velocity is established by causing the magnets 15 to change their flux density through which the cylinder must pass as the speed of the cylinder increases. In the first embodiment, this is done by the magnets 15 rotating on a centerline that is eccentric to the axis of rotation of the conductive cylinder 25. In this embodiment, the centerline of the axle 23 and the centerline of rotation of the magnet 15 and the magnet carrier 17 are offset from one another by the eccentric axle 20.

Figure 7:
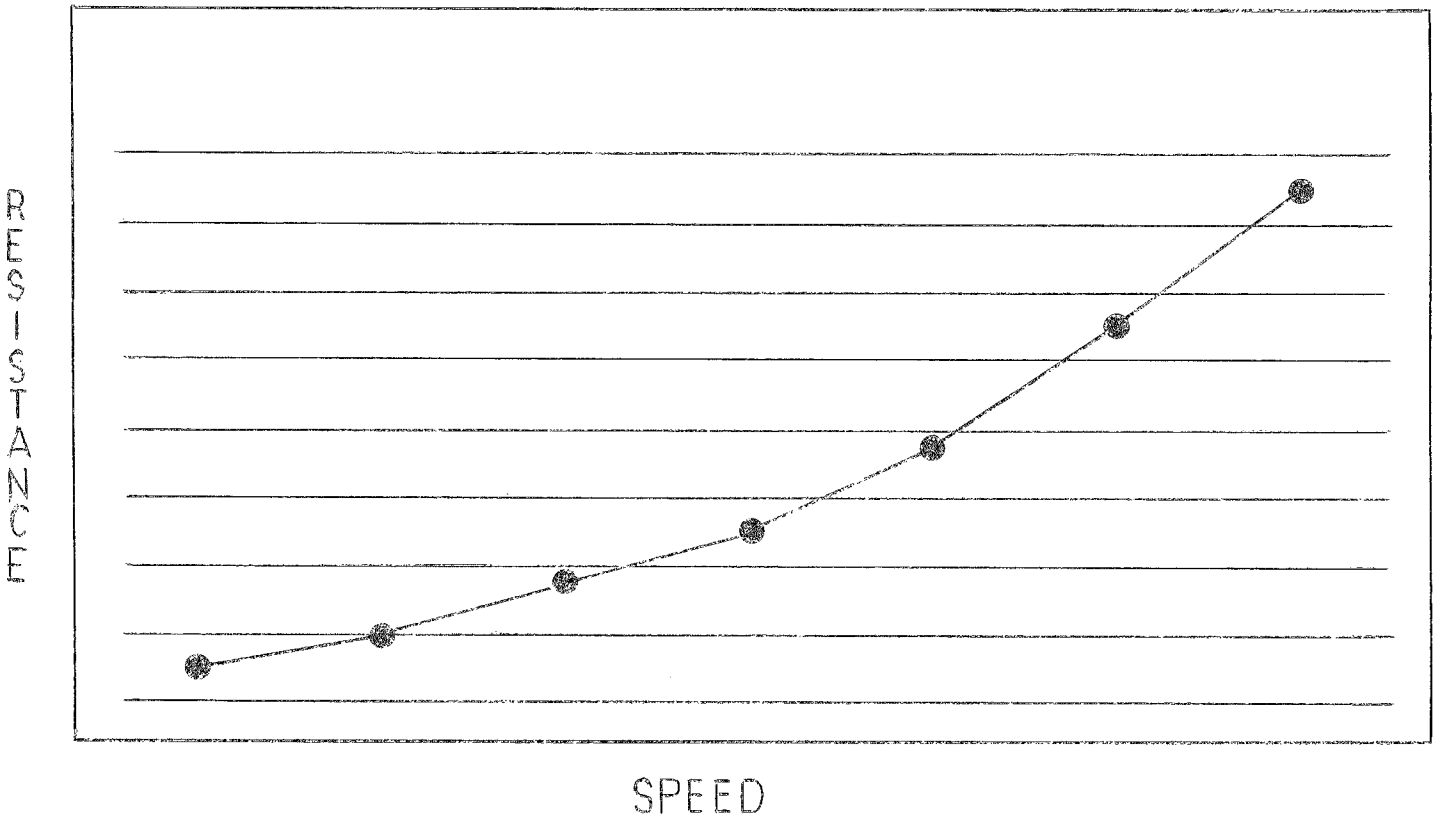
FIG. 7 is a graph showing power output per rotational speed for various progressive resistance device.

The resulting relationship between speed of rotation and power is demonstrated by FIG. 7, which shows data points taken from product testing of the configuration represented herein. The X-axis represents bicycle speed as measured in miles per hour (MPH), which is directly proportional to cylinder rotational speed. The Y-axis represents power produced by the rotation of the cylinder 25, as measured in Watts. The non-linear increase in power with increasing speed is similar to actual conditions when riding a bicycle outdoors, representing the combined effects of rolling resistance and aerodynamic resistance.

In one embodiment, a rotational stop 24 is employed to limit the rotation of the magnet carrier 17 relative the cylinder 25, as described above. Limiting rotation in either direction of rotation will limit the range of magnet gap between the cylinder and magnet which will have a corresponding effect on resistance to allow production of a desired power/speed curve.

Figure 8:
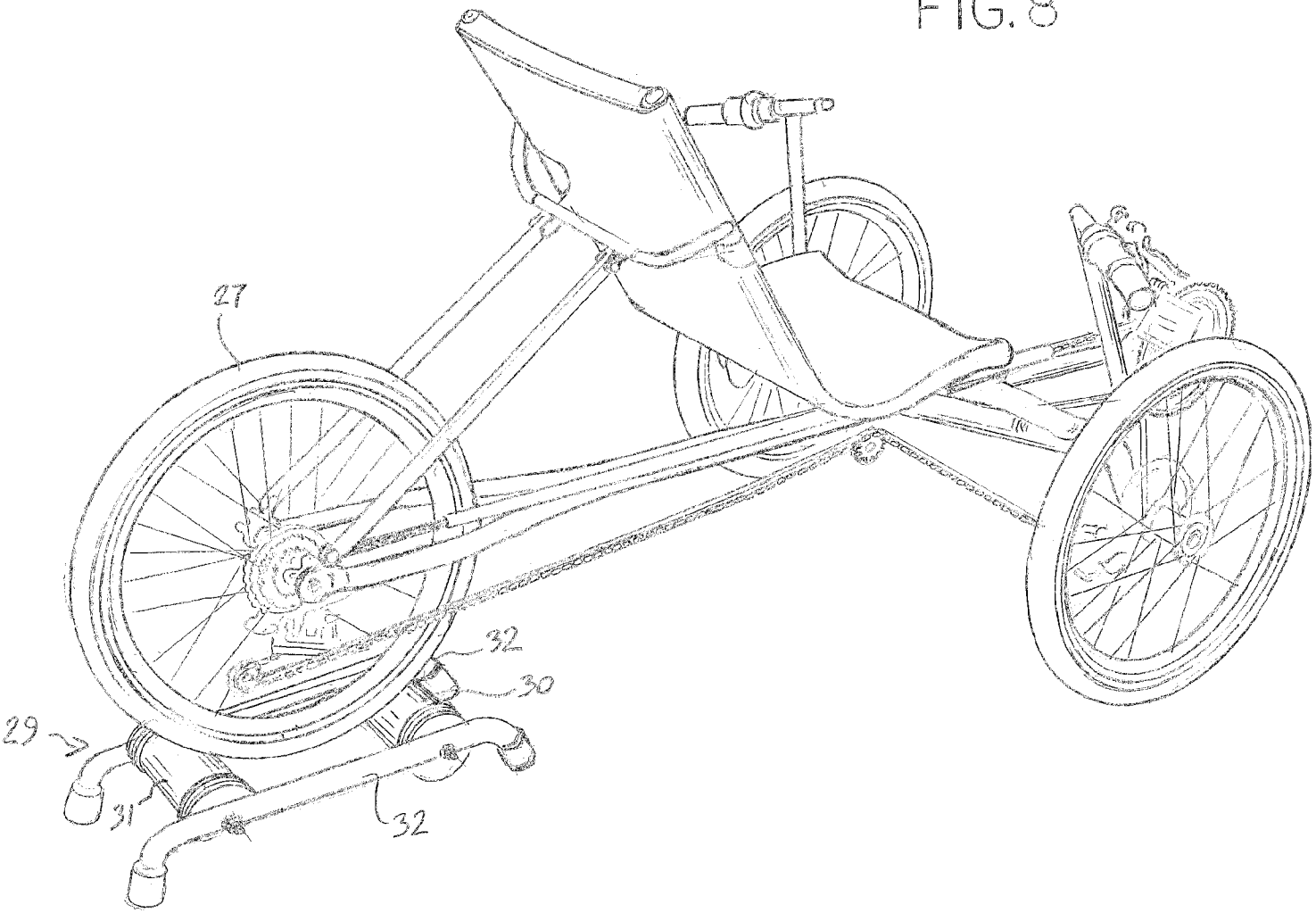
FIG. 8 is a perspective view of a recumbent tricycle on a training roller assembly.
Figure 9:
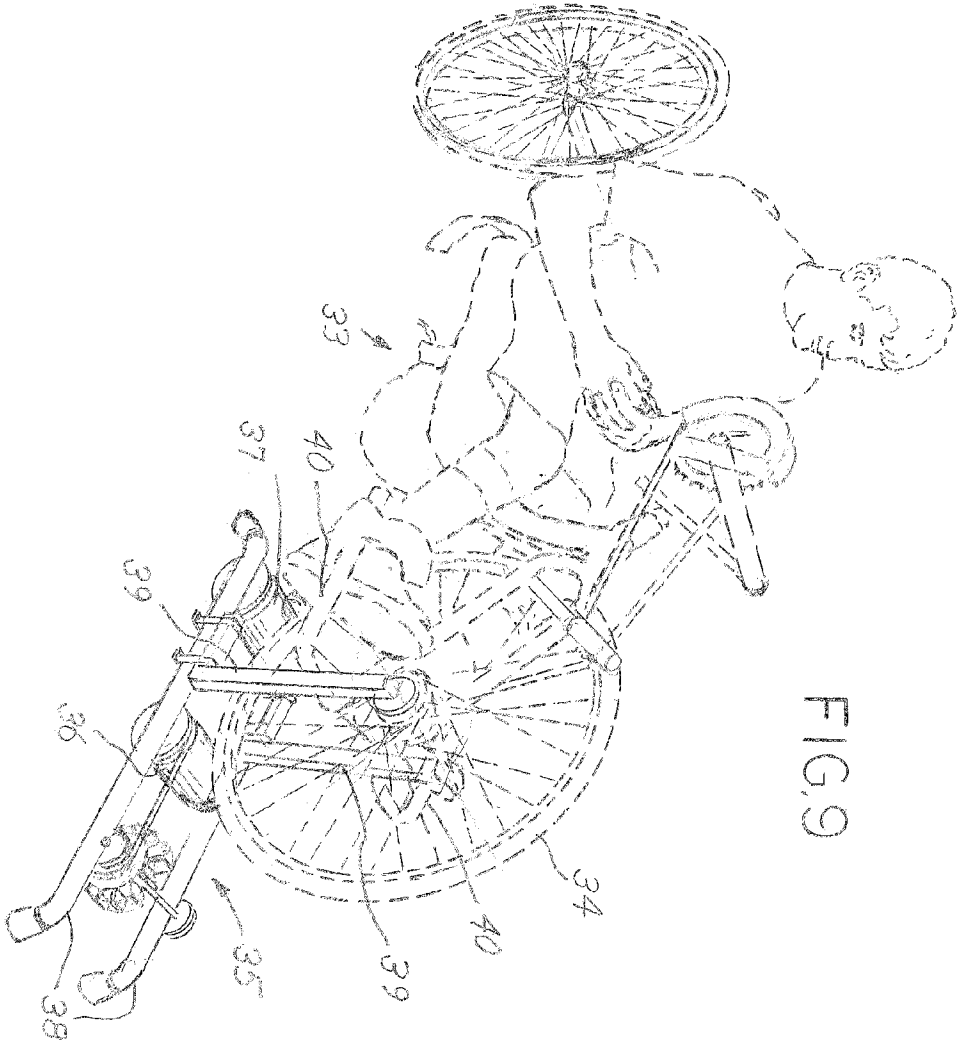
FIG. 9 is a perspective view of a hand-cycle on a training roller assembly.

The resistance mechanism 42 described herein can be employed on other devices used with human-powered three-wheeled vehicles such as tricycles and handcycles. As shown in FIGS. 8 and 9, a smaller roller assembly using two rotating drums is employed to allow the driven wheel to rotate under human power while the vehicle remains stationary. One or both of the drums in this embodiment can house the resistance mechanism of the present disclosure.

FIG. 8 shows an alternative embodiment where the rear wheel 27 of a recumbent tricycle 26 is mounted on top of a trainer 29 consisting of two cylindrical drums—a front drum 30 and a rear drum 31—and a frame having two rails 32 to which the drums are affixed. In this embodiment, either the front drum 30, the rear drum 31, or both, house the resistance mechanism 42 as heretofore described.

Figure 10:
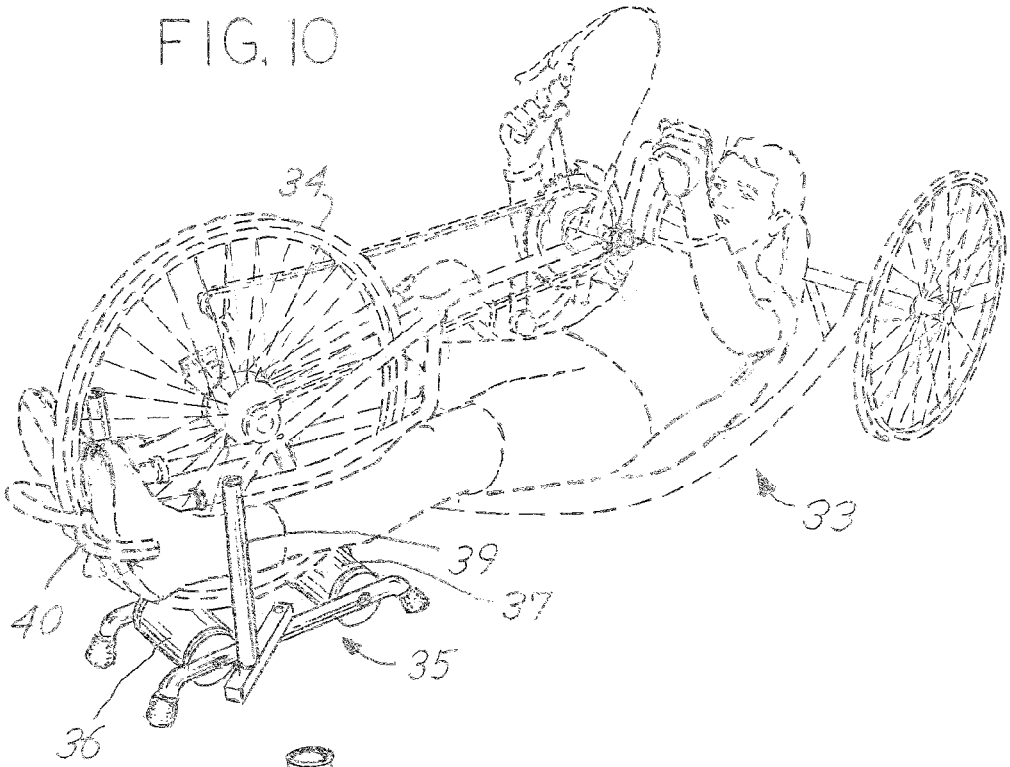
FIG. 10 is a perspective view of an alternative embodiment of the progressive resistance device having upright members.
Figure 11:
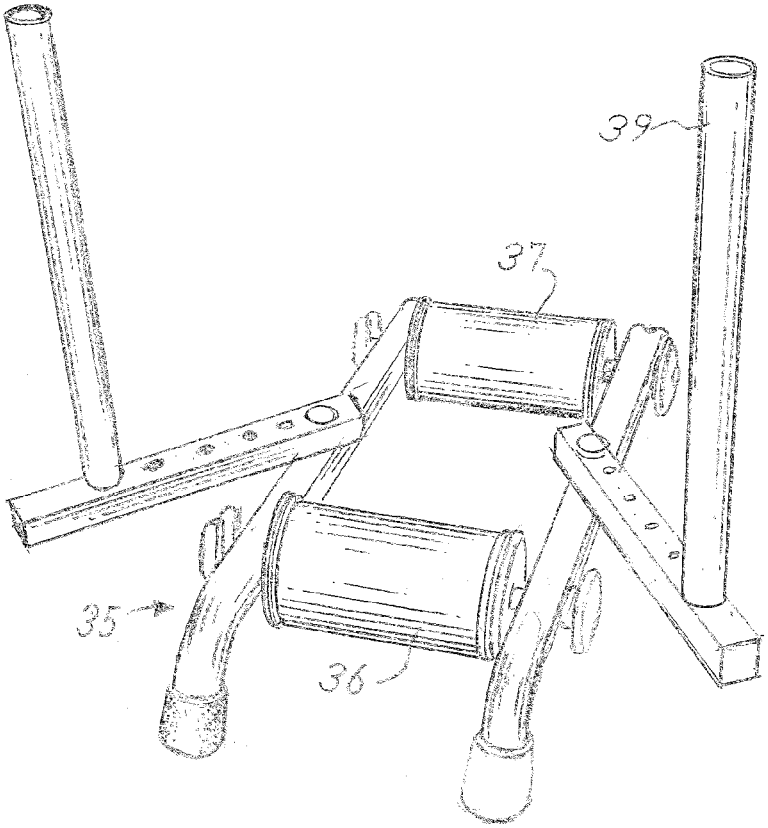
FIG. 11 is a perspective view of the progressive resistance device having upright members of FIG. 10.

FIG. 9 shows an additional embodiment where the front wheel 34 of a handcycle 33 is mounted on top of a trainer 35 consisting of two cylindrical drums—a front drum 36 and a rear drum 37—and a frame having two rails 38 to which the drums are affixed. A pair upwardly-extending arms 39 are affixed to the frame, each extending upwardly from one of rails 38 in such a way that each arm can be adjusted to contact one of the outer rails of the handcycle's leg rests 40. The arms 39 are positioned in such a way that they contact the leg rests forward of the axis of steering rotation so that the handcycle remains stable as it is being pedaled on the trainer 35 by the user. In this embodiment, either the front drum 36, the rear drum 37, or both, house the resistance mechanism 42 as heretofore described. FIG. 10 shows an alternative embodiment of the trainer 35 as used with a handcycle 33.

A further embodiment includes a cylindrical magnet (not shown) which is mounted in close proximity to the outer surface of the conductive cylinder 25. In this embodiment, the magnet does not rotate on a concentric centerline to the drum centerline, but instead is initially oriented such that the equator of said magnet(s) is oriented toward said conductive cylinder when the cylinder is at rest. As said cylinder rotates, the cylindrical magnet(s) (not shown) will rotate on their axis against a torsional spring 41 (not shown) such that one of the poles of the magnet will become oriented in the direction of the conductive cylinder as the cylinder 25 increases in rotational speed. Since the magnetic flux field near the equator of a cylindrical magnet is less dense than the magnetic flux field at the magnet's poles, the effect of power versus cylinder rotations speed is comparable to the embodiment with magnets positioned inside the conductive cylinder.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A progressive resistance device comprising:

a cylinder having an outer wall defining an inner chamber;

an axle having a central axis about which said cylinder is rotatable;

an eccentric axle surrounding said axle;

a magnet carrier partially encircling said eccentric axle;

a magnet pivotable about said eccentric axle;

whereby the distance between said magnet and said outer wall is variable as defined by the rotative position of said magnet relative said outer wall.

2. The progressive resistance device of claim 1, wherein said magnet is rotatable between a resting position and a displaced position, said central axis located between said eccentric axis and said magnet in said resting position.

3. The progressive resistance device of claim 2, a spring biasing said magnet toward said resting position.

4. The progressive resistance device of claim 1, said magnet being carried on a magnet carrier, and a stop having an inwardly extending tab holding said stop in fixed rotational alignment with said eccentric axle; said stop having an outwardly extending tab limiting rotation of said magnet carrier relative said eccentric axle.

5. The progressive resistance device of claim 4, and a groove formed in said eccentric axle for accepting said inwardly extending tab, and a gap formed in said magnet carrier for accepting said outwardly extending tab.

6. The progressive resistance device of claim 1, and a roller-type bicycle trainer having a first roller and a second roller supported on a frame, one of said rollers is said progressive resistance device.

7. A progressive resistance device comprising:

a cylindrical drum having an outer wall defining an internal chamber, said cylindrical drum rotatable about an axle on a central axis;

a resistance mechanism located in said internal chamber having an eccentric axle affixed to said axle and having an eccentric axis, said eccentric axis being offset from said central axis, said resistance mechanism having a magnet held adjacent to and spaced from said outer wall by a magnet carrier, said magnet carrier pivotable about said eccentric axis between a resting position and a displaced position;

said resistance mechanism having a spring biasing said magnet carrier toward said resting position; and when said magnet carrier is in said resting position, said magnet is located at a relatively far distance from said outer wall, when said magnet carrier is in said displaced position, said magnet is located at a relatively close distance to said outer wall.

8. The progressive resistance device of claim 7, said eccentric axle having an outside diameter adapted to receive a bearing, said bearing adapted to receive said rotatable magnet carrier.

9. The progressive resistance device of claim 8, said resistance mechanism having a stop limiting the rotation of said magnet carrier.

10. The progressive resistance device of claim 7, and a second cylindrical drum rotatable about a second axle, a frame affixing said axle substantially parallel to said second axle.

11. A progressive resistance device comprising:

a cylindrical drum having an outer wall defining an internal chamber, said cylindrical drum rotatable about an axle on a central axis;

a resistance mechanism located in said internal chamber having an eccentric axle affixed to said axle and having an eccentric axis, said eccentric axis being offset from said central axis, said resistance mechanism having a magnet held adjacent to and spaced from said outer wall, said magnet pivotable about said eccentric axis between a resting position and a displaced position;

said resistance mechanism having a spring biasing said magnet toward said resting position; and when said magnet is in said resting position, said magnet is located at a relatively far distance from said outer wall, when said magnet is in said displaced position, said magnet is located at a relatively close distance to said outer wall.

12. The progressive resistance device of claim 11, said eccentric axle having an inside diameter and an outside diameter, said outside diameter adapted to receive a bearing and having an axis offset from said inside diameter.

13. The progressive resistance device of claim 11, said central axis located between said eccentric axis and said magnet in said resting position.

14. The progressive resistance device of claim 13, said magnet being carried by a magnet carrier, said bearing adapted to receive said magnet carrier.

15. The progressive resistance device of claim 14, said magnet carrier having a spring circumscribing a portion of said eccentric axle and urging said rotatable portion toward said resting position.

16. The progressive resistance device of claim 11, said resistance mechanism having a stop limiting the rotation of said magnet.

17. The progressive resistance device of claim 16, said stop having an inwardly extending tab holding said stop in fixed rotational alignment with respect to said eccentric axle; said stop having an outwardly extending tab limiting rotation of said magnet carrier relative said eccentric axle.

18. The progressive resistance device of claim 11, and a second cylindrical drum rotatable about a second axle, a frame affixing said axle substantially parallel to said second axle.

19. The progressive resistance device of claim 18, said frame having a pair of upright arms extending upwardly from said frame.

20. The progressive resistance device of claim 19, said second cylindrical drum having a second resistance mechanism.

* * * * *